US006360905B1

(12) United States Patent
Frommelt et al.

(10) Patent No.: US 6,360,905 B1
(45) Date of Patent: Mar. 26, 2002

(54) CRAWLER-MOUNTED CRANE WITH DETACHABLE LATERAL STABLIZERS

(75) Inventors: Uwe Frommelt, Ehingen; Hans-Dieter Willim, Unterweiler, both of (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 09/631,985

(22) Filed: Aug. 3, 2000

(30) Foreign Application Priority Data

| | | |
|---|---|---|
| Aug. 4, 1999 | (DE) | 299 13 608 U |
| Sep. 1, 1999 | (DE) | 299 15 375 U |
| Apr. 25, 2000 | (DE) | 100 20 270 |

(51) Int. Cl.[7] ..... B66C 23/78
(52) U.S. Cl. ..... 212/302; 212/175
(58) Field of Search ..... 212/302, 303, 212/304, 305, 175

(56) References Cited

U.S. PATENT DOCUMENTS

| | | | | |
|---|---|---|---|---|
| 3,021,016 A | * | 2/1962 | Noll et al. | 212/304 |
| 3,608,756 A | | 9/1971 | Guinot | 214/138 |
| 3,929,204 A | * | 12/1975 | Newell | 212/145 |
| 4,042,115 A | * | 8/1977 | Beduhn et al. | 212/48 |
| 4,266,679 A | * | 5/1981 | Juergens | 212/181 |
| 4,387,814 A | * | 6/1983 | Beduhn et al. | 212/302 |
| 4,394,911 A | * | 7/1983 | Wittman et al. | 212/304 |
| 4,624,357 A | * | 11/1986 | Oury et al. | 198/313 |
| 4,640,421 A | * | 2/1987 | Mason | 212/304 |

FOREIGN PATENT DOCUMENTS

| | | | | |
|---|---|---|---|---|
| DE | 1172820 | * | 6/1964 | 212/305 |
| DE | 117 663 | | 1/1976 | |
| DE | 33 10 491 | | 7/1987 | |
| JP | 354-140349 | * | 10/1979 | 212/304 |
| WO | 97/08026 | * | 3/1997 | |

* cited by examiner

*Primary Examiner*—Thomas J. Brahan
(74) *Attorney, Agent, or Firm*—Jacobson Holman, PLLC

(57) ABSTRACT

The chassis of a mobile crane, which supports a revolving superstructure having a jib and a counter-jib, is detachably connected to lateral crawlers. To create a favourable stabilisation area for the crawler-mounted crane, cantilevering stabilisers are attachable to the outsides of the crawlers.

8 Claims, 1 Drawing Sheet

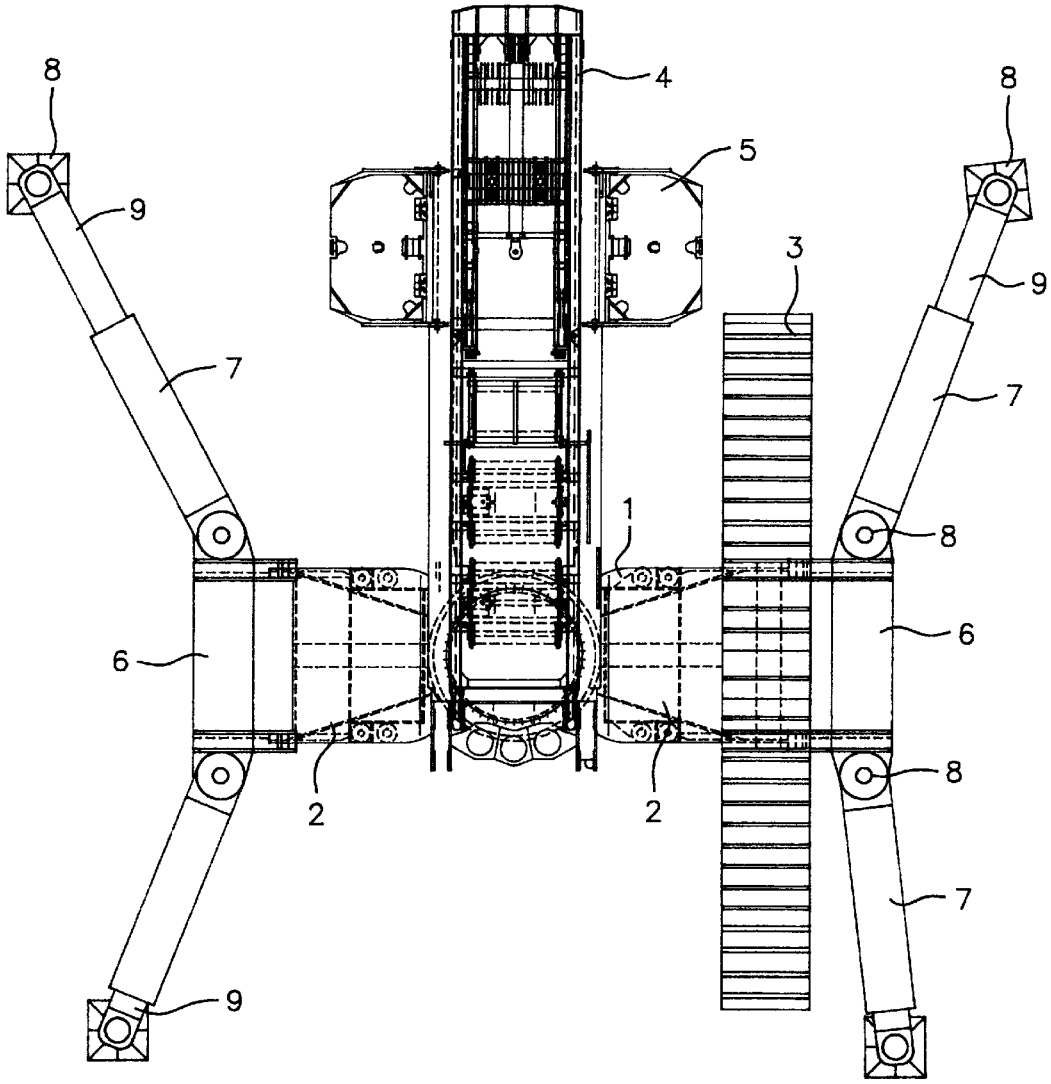
8
9
7
6
2
9
4
5
1
3
8
9
7
8
6
8
7

CRAWLER-MOUNTED CRANE WITH DETACHABLE LATERAL STABLIZERS

BACKGROUND OF THE INVENTION

1. Field of the Invention

The invention relates to a mobile crane with a chassis bearing the revolving superstructure having a jib and counter-jib, which is detachably connected to lateral crawlers.

2. Description of the Related Art

Mobile cranes are generally provided with crawler tracks instead of wheels if the crane is travelled on the construction site with equipment and ballast and possibly with load. If the undercarriage comprises a chassis connected to crawlers, the stabilisation area of the crawler-mounted crane is determined by the rear-end tread rollers of the crawlers which define a rectangular stabilisation area. The revolving superstructure pivoted on the undercarriage carries the jib, which can be a telescoping jib, and a counter-jib which bears a counter-ballast.

If the jib is luffed, the effective stabilisation area under the crawler tracks can change. If, in such a case with a crawler-mounted crane, the centre of gravity migrates due to the luffing of the jib or the taking up of load in the direction of one end of the crawlers, the stabilisation area becomes smaller to the degree in which the centre of gravity migrates towards one crawler track end. The subgrade reaction increases accordingly, which can lead to a failure of the ground contact area (shear failure), whereby the crane can overturn.

A particular problem occurs if the jib takes up a steep position without load as then the crawler-mounted crane can overturn backwards due to the counterweight at the revolving superstructure. To prevent such a turning over with a steeply positioned jib, the crawler must be ballasted accordingly, for which purpose, for example, additional weights of up to 100 t can be required whose necessity means increased effort. The additional weights not only make additional transport necessary, but also an increased effort in assembly.

SUMMARY OF THE INVENTION

It is therefore the object of the invention to provide a crawler-mounted crane of the kind first given which has a favourable stabilisation area so that the problem of counter-ballasting does not result even with a steeply positioned jib.

It is another object of the invention to achieve an increase in the stabilisation base, on the one hand to allow high loads to be hoisted with large jib radii and low ballast and, on the other hand, to allow the raising of long jib systems.

It is another object of the invention to allow the crane to be aligned horizontally even with an uneven contact area.

These objects are solved in accordance with the invention by cantilevering stabilisers being attachable to the outsides of the crawlers.

With the crawler-mounted crane in accordance with the invention, essentially only the cantilevering stabilisers define the rectangular or square stabilisation area so that the size of the effective stabilisation area generally does not change even when the centre of gravity migrates in the direction of an overturn edge. If the stabiliser bases disposed on the stabilisers define the standard rectangle, under strain an increased consolidation occurs under the stabilisers which, however, only leads to a slight shift in the centre of gravity. The stabilisation area under the stabilising cylinders remains constant.

Appropriately, brackets can be pinned or otherwise connected to the crawlers, which brackets bear two cantilevering stabilisers each. Appropriately, vertical hydraulic cylinders are fastened to the ends of the stabilisers with whose aid the crane can be aligned horizontally even with uneven ground.

In another aspect of the invention, it is provided that the stabilisers are swivellably supported on the brackets. This embodiment does not only allow an adjustment of the rectangular stabilisation area, but also permits the alignment of the stabilisers in line with the bracket so that they can be laid down in their extended form for their transport on a transport vehicle such as a low-bed trailer. If the stabilisers are fixedly connected to the bracket in trapezoid form, they cannot be transported in a space-saving manner so that it can be necessary to provide a special transport vehicle for each stabiliser pair with bracket.

Appropriately, the stabilisers can be telescoped out to reduce the transport dimensions and, when little space is available, to reduce the required stabilisation area.

According to another further development of the invention, it is provided that the stabilisers can be directly pinned or connected in another manner to the chassis after the crawlers have been removed. In this way, the undercarriage can be designed as a portal with good stability properties. The transportation and assembly of the crawlers can be dispensed with in this case.

The stabilisers can also be connected to the chassis by the interposing of intermediate brackets so that in this way, the size of the stabilisation area or of the positional rectangle can be additionally increased.

BRIEF DESCRIPTION OF THE DRAWINGS

An embodiment of the invention is described in more detail below by means of the drawing in whose single FIGURE a top view of a crawler-mounted crane is shown whose chassis is, however, only provided with a crawler on one side and where on the other side of the chassis, the stabilisers are attached directly to illustrate the possibility of refitting.

DETAILED DESCRIPTION OF THE PREFFERED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The crawler-mounted crane in accordance with the invention comprises a chassis I having laterally cantilevering side parts 2 to whose ends crawlers 3 are pinned in a conventional manner.

In the basic form, a crawler 3 is also pinned to the left side of the chassis in the manner visible from the right side.

A revolving superstructure is pivoted on the undercarriage comprising the chassis 1 and the crawlers 3 laterally pinned thereto in a conventional manner by a slewing crown provided with a drive. A raising block 4 and the ballast 5 are connected to the deck of the revolving superstructure in the manner shown. A jib (not shown) is articulated on the revolving superstructure in a conventional manner, the jib also being able to consist of a telescoping jib. To this extent, the crawler-mounted crane is of a generally known construction.

To stabilise the crawler-mounted crane with a favourable square stabilisation area, on both outer sides of the crawlers 3, brackets 6 can be pinned or otherwise connected to the frame of crawlers and can support cantilevering stabilisers 7 at angles to the roughly box-shaped brackets 6. These stabilisers enclose suitable angles with the bracket 6.

In the preferred embodiment shown, the stabilisers 7 are connected to the bracket 6 in an articulated manner by means of pins 8 so that a suitable angle can be set manually or via drives (not shown).

At their ends, the stabilisers 7 support plate-shaped stabiliser bases 8 which are connected to the ends of the stabilisers 7 in a conventional manner by hydraulic cylinders.

In the embodiment shown, the stabilisers are telescoping, with a favourable stabiliser length being able to be selected by telescoping out a stabiliser extension 9.

From the left side of the FIGURE another enhancement is shown. In this embodiment the two crawlers 3 are removed from the chassis 1 and in their place, the brackets 6 are directly pinned or otherwise connected to the laterally cantilevering parts 2 of the chassis 1. In this way, a stable portal is created which allows a safe operation of the crawler-mounted crane refitted in this way.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

We claim:

1. A mobile crane comprising a chassis supporting a superstructure for rotation about a vertical axis, a pair of lateral crawlers connected to side parts of said chassis through respective crawlers frames, plurality of lateral stabilizers for stabilizing said chassis, each of said stabilizers having a first end for support and a second end connecting to said crane, and a pair of brackets with each bracket supporting two of said lateral stabilizers for rotation of each stabilizer about an independent generally vertical axis so that each stabilizer can swivel forward and rearward, each of said brackets being detachably connected to one of said crawler frames when the crawler frames are mounted to said side parts of the chassis and being detachably connected to one of said side parts of the chassis when said crawler frames are removed, said stabilizers telescoping so as to adjust a laterally cantilevering length of said stabilizers and thus the stabilization area.

2. The crane according to claim 1, wherein said stabilizers are connected to said brackets using pins, and positioning of said first ends of said stabilizers is rotatably adjustable independently of other stabilizers.

3. The crane according to claim 2, wherein said first ends of said stabilizers include plate-shaped stabilizer bases that contact the ground.

4. The crane according to claim 2, wherein said first ends do not travel along a common arc when being rotated.

5. A mobile crane comprising a chassis supporting a superstructure for rotation about a vertical axis, two pairs of lateral stabilizers for stabilizing said chassis, a pair of lateral crawlers respectively connected to two side parts of said chassis through a respective pair of crawler frames, and a pair of brackets respectively connected to either said pair of crawler frames when said crawler frames are connected to said side parts, or directly to said two side parts of said chassis when said crawler frames are absent, each of said stabilizers having a first end for ground support and a second end connecting to a respective one of said pair of brackets, each bracket supporting one pair of stabilizers with each stabilizer turning about an individual generally vertical axis so that each stabilizer can swivel forward and rearward independently of the other stabilizers.

6. The crane according to claim 5, wherein said stabilizers are connected to said brackets using pins such that ground placement of said first ends of said stabilizers is rotatably adjustable independently of other stabilizers.

7. The crane according to claim 5, wherein said stabilizers include telescoping stabilizers allowing adjustment in a length thereof between their first and second ends.

8. The crane according to claim 7, wherein said first ends of said stabilizers include plate-shaped stabilizer bases that contact the ground.

* * * * *